US011278179B2

(12) United States Patent
Brewer et al.

(10) Patent No.: US 11,278,179 B2
(45) Date of Patent: Mar. 22, 2022

(54) STATUS INDICATOR AND LIGHTING ASSEMBLY FOR AN APPLIANCE DOOR

(71) Applicant: Haier US Appliance Solutions, Inc., Wilmington, DE (US)

(72) Inventors: Kyle James Brewer, Louisville, KY (US); Sanchit Jitendra Patel, Louisville, KY (US); Brian Steven Riddle, Taylorsville, KY (US); Timothy David Kaiser, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 338 days.

(21) Appl. No.: 16/391,741

(22) Filed: Apr. 23, 2019

(65) Prior Publication Data

US 2020/0337522 A1 Oct. 29, 2020

(51) Int. Cl.
*A47L 15/42* (2006.01)

(52) U.S. Cl.
CPC ..... *A47L 15/4293* (2013.01); *A47L 15/4257* (2013.01); *A47L 15/4265* (2013.01)

(58) Field of Classification Search
CPC ..... A47L 15/4257; A47L 15/4265; A47L 15/4293
See application file for complete search history.

(56) References Cited

U.S. PATENT DOCUMENTS

| | | | | |
|---|---|---|---|---|
| 9,683,731 | B2 | 6/2017 | Kim et al. | |
| 2012/0320345 | A1* | 12/2012 | Kleinert | A47L 15/4293 353/98 |
| 2017/0188787 | A1 | 7/2017 | Min et al. | |
| 2019/0046003 | A1* | 2/2019 | Ryan | H01H 13/83 |
| 2019/0226673 | A1* | 7/2019 | Benton | F21V 33/0044 |

FOREIGN PATENT DOCUMENTS

| | | | |
|---|---|---|---|
| CN | 204427974 | U | 7/2015 |
| EP | 2363056 | B1 | 9/2011 |
| JP | 4786992 | B2 | 10/2011 |
| WO | WO2018065202 | A1 | 4/2018 |

* cited by examiner

*Primary Examiner* — Joseph L. Perrin
*Assistant Examiner* — Kevin G Lee
(74) *Attorney, Agent, or Firm* — Dority & Manning, P.A.

(57) ABSTRACT

A door assembly for an appliance includes an inner door panel and outer door panel that define an interior chamber for receiving at least a first light source and a second light source. An indicator lens extends from a split receiving surface facing the light sources to an indicator aperture defined in the outer door panel. The split receiving surface has a first surface for receiving light from the first light source and a second surface for receiving light from the second light source. In addition, an opaque partition is positioned between the first light source and the second light source for at least partially blocking light from first light source and the second light source from bleeding onto the second surface and the first surface, respectively.

20 Claims, 7 Drawing Sheets

STATUS INDICATOR AND LIGHTING ASSEMBLY FOR AN APPLIANCE DOOR

FIELD OF THE INVENTION

The present subject matter relates generally to door assemblies for appliances, and more particularly to lighting assemblies and status indicators mounted within doors of appliances.

BACKGROUND OF THE INVENTION

Appliances frequently include doors for closing, insulating, concealing, or otherwise providing selective access to cavities or chambers of the appliance. These doors typically include an inner and outer door that are separated by an air gap which may be filled with fiberglass or insulating foam, e.g., for thermal insulation, sound dampening, etc. In order to provide a user with information regarding the appliance operation, e.g., such as a status of an operating cycle or an indication that a cycle is complete, status indicators are often positioned on the outer door of the appliance such that they are visible to a user of the appliance.

The status indicators are often light diffusers or light pipes that simply diffuse or transmit light generated by a separate light source. Such light sources are commonly mounted on a light board or a control panel as part of a discrete attachment or assembly mounted to the appliance door, e.g., to reduce wiring complexity of such light sources and to simplify the assembly of the door. Door assembly may be particularly complex if the light sources are mounted to a control board which is provided along a top portion of the door (e.g., perpendicular to the status indicators at a front portion of the door). When mounted in this manner, the door assembly must include features for transmitting light to the status indicators on the front of the door. However, conventional lighting assemblies and features for transmitting light may suffer from a lack of brightness, intensity, uniformity, and versatility of illumination.

Accordingly, an appliance having features for simplified assembly and improved illumination of status indicators would be useful. More specifically, a lighting assembly for an appliance having improved visual indicators, simplified assembly, and minimal space requirements would be particularly beneficial.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a door assembly for an appliance is provided. The door assembly includes an outer door panel defining an indicator aperture and an inner door panel spaced apart from the outer door panel to define an interior chamber. A first light source selectively emits a first portion of light energy, a second light source selectively emits a second portion of light energy, and an indicator lens extends from a projection surface proximate the indicator aperture and a split receiving surface, the split receiving surface having a first surface facing the first light source and a second surface facing the second light source. An opaque partition is positioned between the first light source and the second light source for at least partially blocking the first portion of light energy from reaching the second surface and the second portion of light energy from reaching the first surface.

In another exemplary aspect of the present disclosure, a dishwasher appliance defining a vertical direction, a lateral direction, and a transverse direction is provided. The dishwasher appliance includes a wash tub positioned within the cabinet and defining a wash chamber and a door assembly pivotally mounted to the cabinet to provide selective access to the wash chamber. The door assembly includes an outer door panel defining an indicator aperture, an inner door panel spaced apart from the outer door panel to define an interior chamber, a first light source selectively emitting a first portion of light energy, and a second light source selectively emitting a second portion of light energy. The door assembly further includes an indicator lens extending from a projection surface proximate the indicator aperture and a split receiving surface, the split receiving surface having a first surface facing the first light source and a second surface facing the second light source and an opaque partition positioned between the first light source and the second light source for at least partially blocking the first portion of light energy from reaching the second surface and the second portion of light energy from reaching the first surface.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
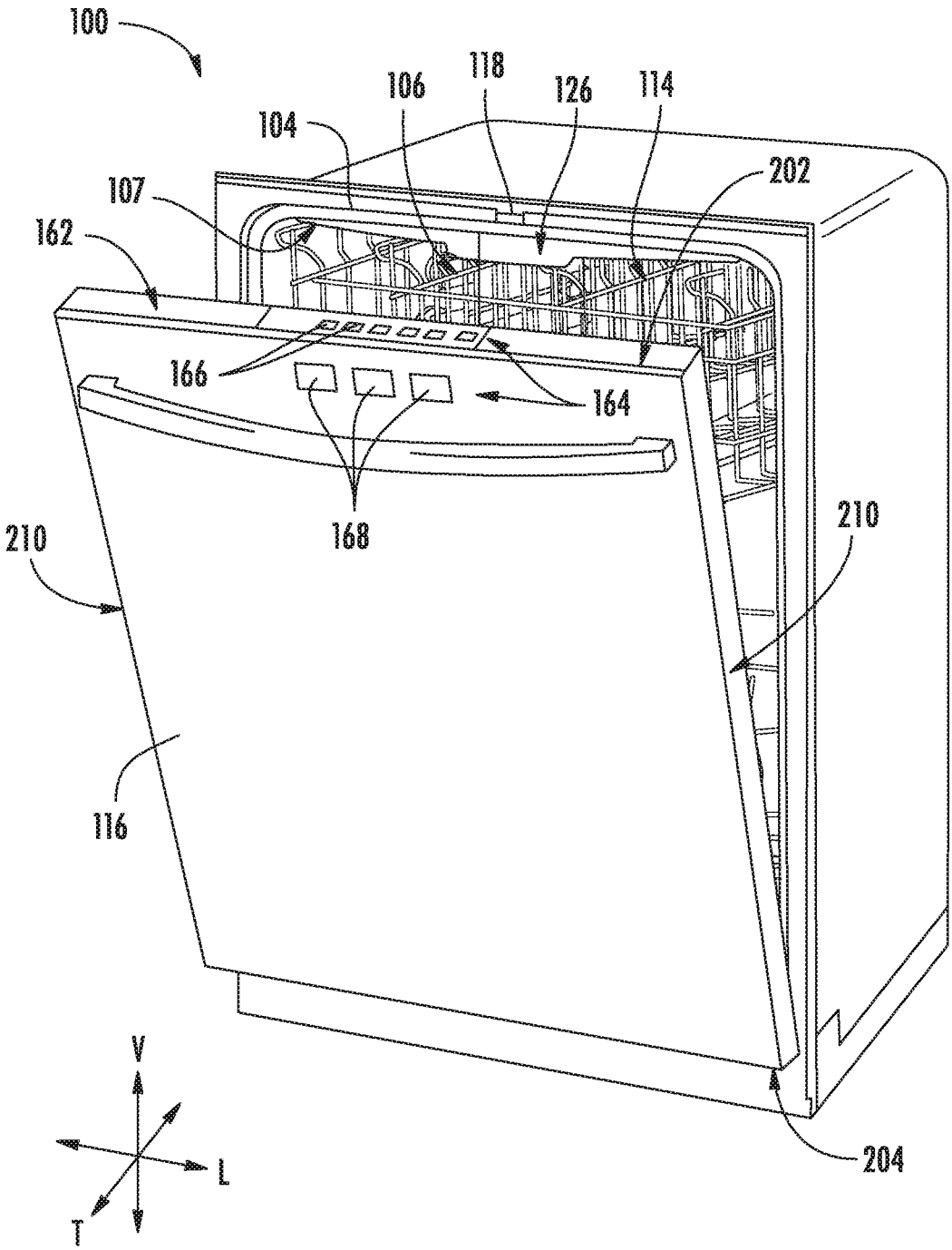
FIG. 1 provides a perspective view of a dishwasher appliance, including a dishwasher door according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. In addition, the term "or" is generally intended to be inclusive (i.e., "A or B" is intended to mean "A or B or both"). Furthermore, as used herein, terms of approximation, such as "approximately," "substantially," or "about," refer to being within a ten percent margin of error.

Figure 2:
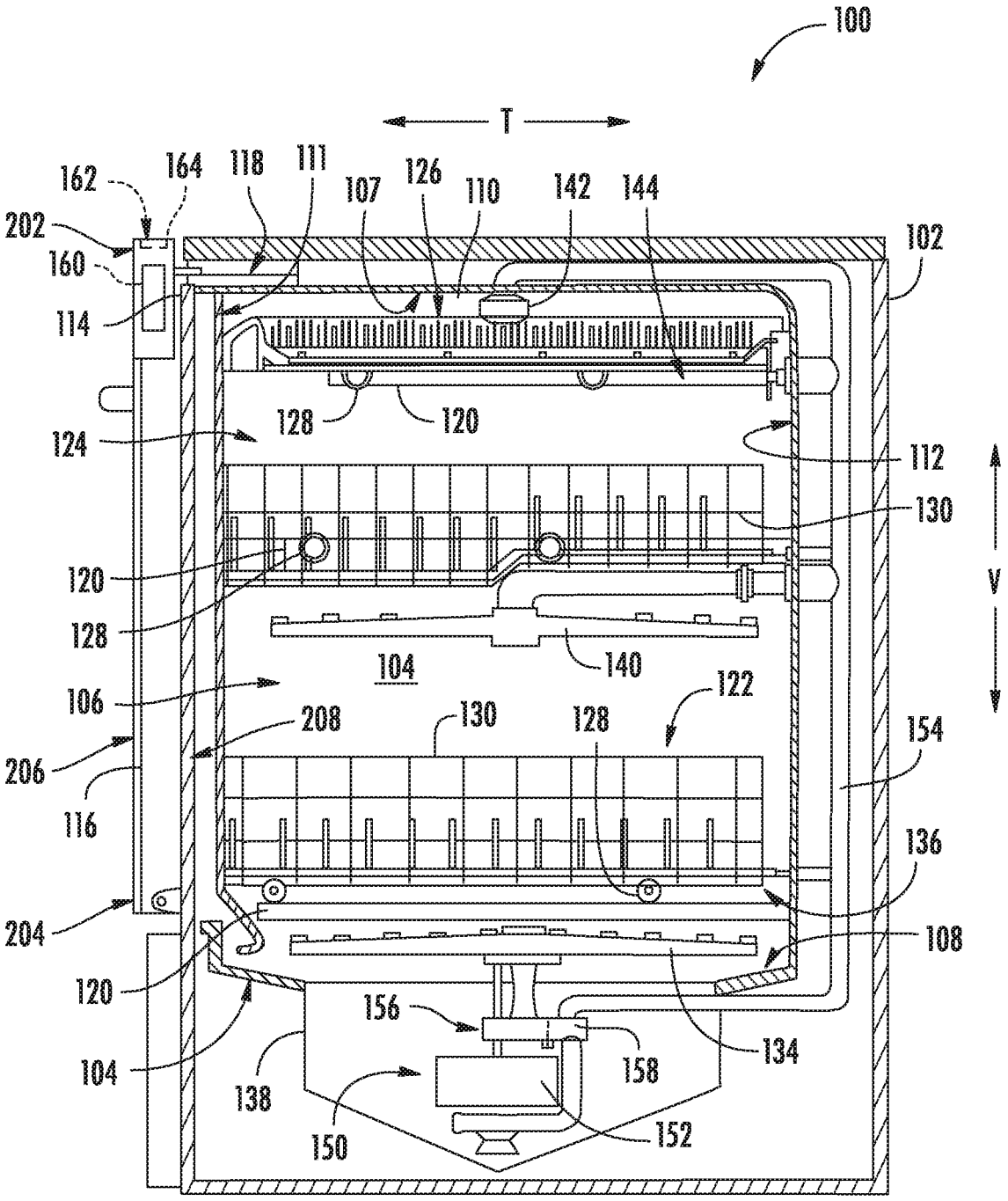
FIG. 2 provides a cross-sectional side view of the exemplary dishwashing appliance of FIG. 1.

FIGS. 1 and 2 depict an exemplary domestic dishwasher or dishwashing appliance 100 that may be configured in accordance with aspects of the present disclosure. For the particular embodiment of FIGS. 1 and 2, the dishwasher 100 includes a cabinet 102 having a tub 104 therein that defines a wash chamber 106. As shown, tub 104 extends between a top 107 and a bottom 108 along a vertical direction V, between a pair of side walls 110 along a lateral direction L, and between a front side 111 and a rear side 112 along a transverse direction T. Each of the vertical direction V, lateral direction L, and transverse direction T are mutually orthogonal to one another.

The tub 104 includes a front opening 114 and a door 116 hinged at its bottom for movement between a normally closed vertical position (shown in FIG. 2), wherein the wash chamber 106 is sealed shut for washing operation, and a horizontal open position for loading and unloading of articles from the dishwasher 100. According to exemplary embodiments, dishwasher 100 further includes a door closure mechanism or assembly 118 that is used to lock and unlock door 116 for accessing and sealing wash chamber 106.

As illustrated in FIG. 2, tub side walls 110 may accommodate a plurality of rack assemblies. More specifically, guide rails 120 may be mounted to side walls 110 for supporting a lower rack assembly 122, a middle rack assembly 124, and an upper rack assembly 126. As illustrated, upper rack assembly 126 is positioned at a top portion of wash chamber 106 above middle rack assembly 124, which is positioned above lower rack assembly 122 along the vertical direction V. Each rack assembly 122, 124, 126 is adapted for movement between an extended loading position (not shown) in which the rack is substantially positioned outside the wash chamber 106, and a retracted position (shown in FIGS. 1 and 2) in which the rack is located inside the wash chamber 106. This is facilitated, for example, by rollers 128 mounted onto rack assemblies 122, 124, 126, respectively. Although a guide rails 120 and rollers 128 are illustrated herein as facilitating movement of the respective rack assemblies 122, 124, 126, it should be appreciated that any suitable sliding mechanism or member may be used according to alternative embodiments.

Some or all of the rack assemblies 122, 124, 126 are fabricated into lattice structures including a plurality of wires or elongated members 130 (for clarity of illustration, not all elongated members making up rack assemblies 122, 124, 126 are shown in FIG. 2). In this regard, rack assemblies 122, 124, 126 are generally configured for supporting articles within wash chamber 106 while allowing a flow of wash fluid to reach and impinge on those articles (e.g., during a cleaning or rinsing cycle). According to another exemplary embodiment, a silverware basket (not shown) may be removably attached to a rack assembly (e.g., lower rack assembly 122) for placement of silverware, utensils, and the like, that are otherwise too small to be accommodated by rack 122.

Dishwasher 100 further includes a plurality of spray assemblies for urging a flow of water or wash fluid onto the articles placed within wash chamber 106. More specifically, as illustrated in FIG. 2, dishwasher 100 includes a lower spray arm assembly 134 disposed in a lower region 136 of wash chamber 106 and above a sump 138 so as to rotate in relatively close proximity to lower rack assembly 122. Similarly, a mid-level spray arm assembly 140 is located in an upper region of wash chamber 106 and may be located below and in close proximity to middle rack assembly 124. In this regard, mid-level spray arm assembly 140 may generally be configured for urging a flow of wash fluid up through middle rack assembly 124 and upper rack assembly 126. Additionally, an upper spray assembly 142 may be located above upper rack assembly 126 along the vertical direction V. In this manner, upper spray assembly 142 may be configured for urging or cascading a flow of wash fluid downward over rack assemblies 122, 124, and 126. As further illustrated in FIG. 2, upper rack assembly 126 may further define an integral spray manifold 144, which is generally configured for urging a flow of wash fluid substantially upward along the vertical direction V through upper rack assembly 126.

The various spray assemblies and manifolds described herein may be part of a fluid distribution system or fluid circulation assembly 150 for circulating water and wash fluid in the tub 104. More specifically, fluid circulation assembly 150 includes a pump 152 for circulating water or wash fluid (e.g., detergent, water, or rinse aid) in the tub 104. Pump 152 may be located within sump 138 or within a machinery compartment located below sump 138 of tub 104, as generally recognized in the art. Fluid circulation assembly 150 may include one or more fluid conduits or circulation piping for directing water or wash fluid from pump 152 to the various spray assemblies and manifolds. For example, as illustrated in FIG. 2, a primary supply conduit 154 may extend from pump 152, along rear 112 of tub 104 along the vertical direction V to supply wash fluid throughout wash chamber 106.

As illustrated, primary supply conduit 154 is used to supply wash fluid to one or more spray assemblies (e.g., to mid-level spray arm assembly 140 and upper spray assembly 142). However, it should be appreciated that according to alternative embodiments, any other suitable plumbing configuration may be used to supply wash fluid throughout the various spray manifolds and assemblies described herein. For example, according to another exemplary embodiment, primary supply conduit 154 could be used to provide wash fluid to mid-level spray arm assembly 140 and a dedicated secondary supply conduit (not shown) could be utilized to provide wash fluid to upper spray assembly 142. Other plumbing configurations may be used for providing wash fluid to the various spray devices and manifolds at any location within dishwasher appliance 100.

Each spray arm assembly 134, 140, 142, integral spray manifold 144, or other spray device may include an arrangement of discharge ports or orifices for directing wash fluid received from pump 152 onto dishes or other articles located in wash chamber 106. The arrangement of the discharge ports, also referred to as jets, apertures, or orifices, may provide a rotational force by virtue of wash fluid flowing through the discharge ports. Alternatively, spray arm assemblies 134, 140, 142 may be motor-driven, or may operate using any other suitable drive mechanism. Spray manifolds and assemblies may also be stationary. The resultant movement of the spray arm assemblies 134, 140, 142 and the spray from fixed manifolds provides coverage of dishes and other dishwasher contents with a washing spray. Other configurations of spray assemblies may be used as well. For example, dishwasher 100 may have additional spray assemblies for cleaning silverware, for scouring casserole dishes, for spraying pots and pans, for cleaning bottles, etc. One skilled in the art will appreciate that the embodiments discussed herein are used for the purpose of explanation only and are not limitations of the present subject matter.

In operation, pump 152 draws wash fluid in from sump 138 and pumps it to a diverter assembly 156 (e.g., which may be positioned within sump 138 of dishwasher appliance 100). Diverter assembly 156 may include a diverter disk (not shown) disposed within a diverter chamber 158 for selectively distributing the wash fluid to the spray arm assemblies 134, 140, 142 or other spray manifolds or devices. For example, the diverter disk may have a plurality of apertures that are configured to align with one or more outlet ports (not shown) at the top of diverter chamber 158. In this manner, the diverter disk may be selectively rotated to provide wash fluid to the desired spray device.

According to an exemplary embodiment, diverter assembly 156 is configured for selectively distributing the flow of wash fluid from pump 152 to various fluid supply conduits, only some of which are illustrated in FIG. 2 for clarity. More specifically, diverter assembly 156 may include four outlet ports (not shown) for supplying wash fluid to a first conduit for rotating lower spray arm assembly 134 in the clockwise direction, a second conduit for rotating lower spray arm assembly 134 in the counter-clockwise direction, a third conduit for spraying an auxiliary rack such as the silverware rack, and a fourth conduit for supply mid-level or upper spray assemblies 140, 142 (e.g., such as primary supply conduit 154).

The dishwasher 100 is further equipped with a controller 160 to regulate operation of the dishwasher 100. The controller 160 may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 160 may be constructed without using a microprocessor (e.g., using a combination of discrete analog or digital logic circuitry, such as switches, amplifiers, integrators, comparators, flip-flops, AND gates, and the like) to perform control functionality instead of relying upon software.

The controller 160 may be positioned in a variety of locations throughout dishwasher 100. In the illustrated embodiment, the controller 160 may be located within a control panel area 162 of door 116, as shown in FIGS. 1 and 2. In such an embodiment, input/output ("I/O") signals may be routed between the control system and various operational components of dishwasher 100 along wiring harnesses that may be routed through the bottom of door 116. Typically, the controller 160 includes a user interface panel 164 through which a user may select various operational features and modes and monitor progress of the dishwasher 100. In one embodiment, the user interface 164 may represent a general purpose I/O ("GPIO") device or functional block. In certain embodiments, the user interface 164 includes input components 166, such as one or more of a variety of electrical, mechanical or electro-mechanical input devices including rotary dials, push buttons, and touch pads. The user interface 164 may further include one or more display components 168, such as a digital display device or one or more indicator light assemblies designed to provide operational feedback to a user. The user interface 164 may be in communication with the controller 160 via one or more signal lines or shared communication busses.

It should be appreciated that the invention is not limited to any particular style, model, or configuration of dishwasher 100. The exemplary embodiment depicted in FIGS. 1 and 2 is for illustrative purposes only. For example, different locations may be provided for user interface 164, different configurations may be provided for rack assemblies 122, 124, 126, different spray arm assemblies 134, 140, 142 and spray manifold configurations may be used, and other differences may be applied while remaining within the scope of the present subject matter. Moreover, aspects of the present subject matter may be applied to other appliances as well, such as refrigerators, ovens, microwaves, etc.

Figure 3:
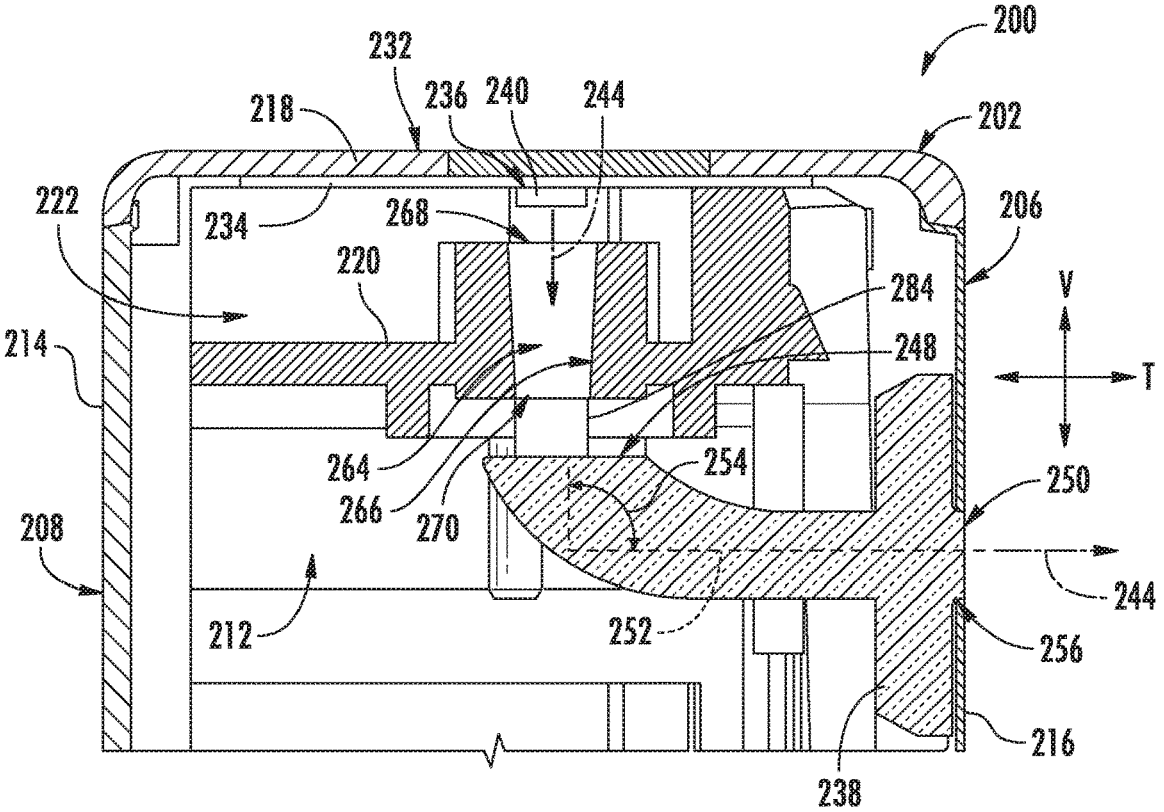
FIG. 3 provides a cross-sectional view of a top portion of a dishwasher door assembly, including a visual indicator, according to exemplary embodiments of the present disclosure.
Figure 4:
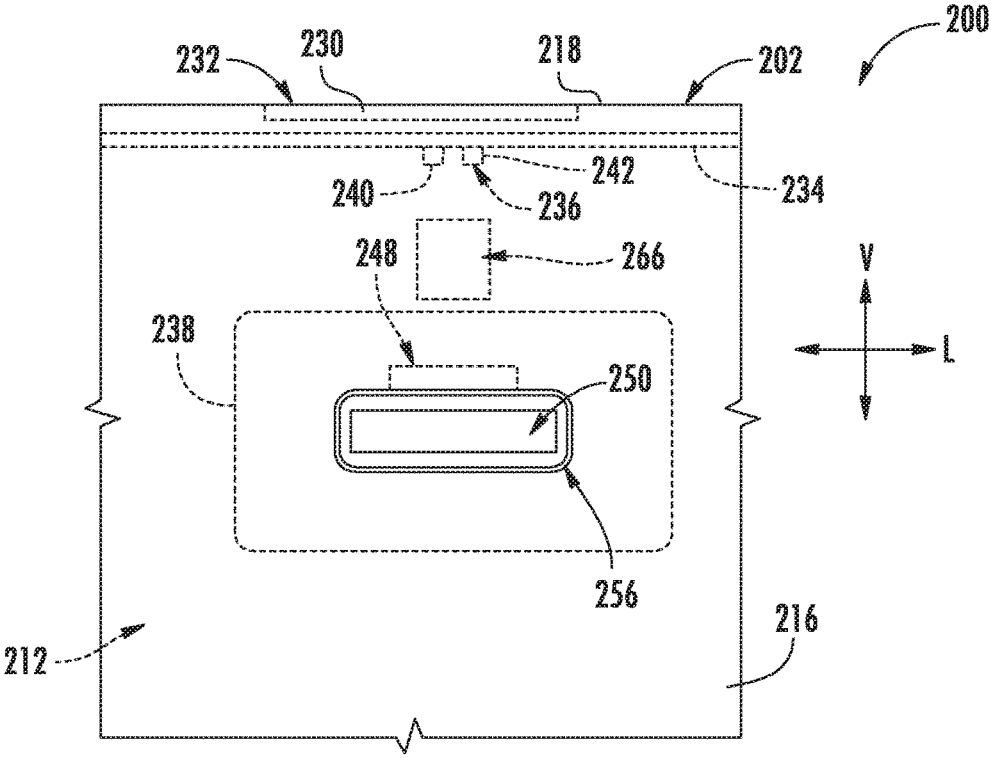
FIG. 4 provides a front view of the visual indicator of the exemplary dishwasher door assembly of FIG. 3.

Referring now generally to FIGS. 3 and 4, a door assembly 200 will be described according to exemplary embodiments of the present subject matter. For example, door assembly 200 may be used as door 116 of dishwashing appliance 100. Alternatively, door assembly 200 may be used on any other suitable residential or commercial appliance. As described herein, door assembly 200 may share a coordinate system with dishwashing appliance 100, e.g., when door assembly 200 is in the closed position (e.g., as shown in FIG. 2). Specifically, door assembly 200 may define a vertical direction V, a lateral direction L, and a transverse direction T. Therefore, these directions will also be used herein to refer to features of door assembly 200 and its various components and sub-assemblies. Referring briefly again to FIGS. 1 and 2, in the normally closed position, door assembly 200 (illustrated for example as door 116) extends from a top end 202 to a bottom end 204 along the vertical direction V; from a front end 206 to a rear end 208 along the transverse direction T; and between two lateral ends 210 along the lateral direction L.

As best illustrated in FIG. 3, door assembly 200 may include one or more exterior panels formed about and defining an interior chamber 212 of door assembly 200. For example, door assembly 200 generally includes an inner door panel 214 and an outer door panel 216 which are spaced apart from each other along the transverse direction T to define a door gap or interior chamber 212 of door assembly 200 therebetween. For instance, outer door panel 216 may be positioned at or proximal to the front end 206 (i.e., distal to the rear end 208) and inner door panel 214 may be positioned at or proximal to the rear end 20 (i.e., distal to the front end 206).

According to exemplary embodiments, inner door panel 214 and outer door panel 216 may be panels that are stamped from stainless steel. Alternatively, inner door panel 214 and outer door panel 216 may be formed from any other suitably rigid material, such as thermoformed plastic, other metals, etc. In general, inner door panel 214 and outer door panel 216 may be assembled in any suitable manner. In addition, inner door panel 214 and outer door panel 216 may be secured together using any suitable mechanical fastener, welding, snap-fit mechanisms, etc. In addition, it should be appreciated that an insulating material (not shown), such as fiberglass or foam insulation, may be positioned within interior chamber 212 to provide thermal and/or sound insulation to dishwashing appliance 100.

A top panel 218 may be positioned on or otherwise attached to inner door panel 214 and outer door panel 216 at the top end 202 of door assembly 200. For instance, top panel 218 may extend rearward from outer door panel 216 along the transverse direction T toward inner door panel 214. In certain embodiments, top panel 218 is positioned perpendicular (i.e., at substantially 90° relative to) outer door panel 216. As should be understood, in some embodiments, outer door panel 216 covers substantially the entire door along the vertical direction V and generally extends from the top end 202 to the bottom end 204 (see, e.g., FIGS. 1 and 2). In additional or alternative embodiments, top panel 218 covers substantially all of the door along the transverse direction T and generally extends from the front end 206 to the rear end 208 (see, e.g., FIG. 2). One or both of outer door panel 216 or top panel 218 may extend between lateral ends 210 of door assembly 200 along the lateral direction L.

Referring again to FIG. 3, door assembly 200 may further include a console bracket 220 which is positioned proximate top end 202 of door assembly 200 along the vertical direction V, e.g., below top panel 218. Specifically, console bracket 220 is positioned between and may be used to join inner door panel 214 and outer door panel 216. In addition, console bracket 220 may define an electronics compartment 222, e.g., between console bracket 220 and top panel 218 along the vertical direction V, for housing various electrical components of dishwasher appliance 100.

In some embodiments, one or more user inputs 166 (e.g., buttons) of user interface 164 may be positioned at a top end 202 of door assembly 200. More specifically, according to the illustrated embodiment of FIG. 3, top panel 218 includes or is provided as a capacitive interface panel 230 (e.g., as part of user interface 164—FIG. 1). As is understood, capacitive interface panel 230 may include one or more user inputs or controls (e.g., inputs 166 to direct or control operations of the dishwasher appliance 100—FIG. 1) on a top surface 232 facing upward to receive a user's engagement or touch thereon. When assembled, capacitive interface panel 230 may be operably coupled to the controller 160. As shown, capacitive interface panel 230 may include a control board 234 (e.g., as part of the controller 160—FIG. 2) positioned below the top surface 232. Specifically, as illustrated, control board 234 may be positioned within electronics compartment 222 which is operably coupled to a user interface panel (e.g. such as interface panel 164 of a dishwashing appliance 100). Thus, control board 234 may be generally hidden from view and within interior chamber 212.

Door assembly 200 may further include features for illuminating one or more status indicators (e.g., indicated in FIG. 1 as display components 168). More specifically, according to an exemplary embodiment, door assembly 200 provides features for facilitating effective lighting of such status indicators using a single color light source, e.g., such as a white or non-colored light emitting diode (LED), while still providing colored light indication, as described below. In addition, such light sources within door assembly 200 are positioned at locations that simplify door assembly, improve indicator illumination, and reduce the space requirements commonly required for such lighting assemblies in conventional appliance doors.

Specifically, according to an exemplary embodiment, a plurality of light sources 236 is positioned within interior chamber 212 to provide light (e.g., light emissions or light energy as described below) to illuminate an indicator lens 238 that may be visible to a user outside of interior chamber 212. As should be understood, the number of light sources 236 and indicator lens 238 illustrated herein are only used for explaining aspects of the present subject matter and are not intended to limit the scope of the disclosure. According to alternative embodiments, any suitable number, position, and configuration of light sources 236 and indicator lenses 238 may be used to illuminate status indicators in any suitable colors, sizes, patterns, etc. Thus, although FIGS. 3 and 4 illustrate a plurality of light sources 236 and a corresponding indicator lens 238 for illuminating a single display indicator 168, it is understood that exemplary embodiments may include multiple similar light sources and indicator lenses, each corresponding to one or more unique display components (e.g., display components 168).

As shown in FIGS. 3 and 4, light sources 236 may be mounted to control board 234 below top panel 218. Additionally or alternatively, light sources 236 may be mounted behind or rearward from outer door panel 216. Light sources 236 may be provided as any suitable number, type, position, and configuration of electrical light source(s), using any suitable light technology and illuminating in any suitable color. For example, according to the illustrated embodiment, light source 236 includes one or more light emitting diodes (LEDs), which may each illuminate in a single color (e.g., white LEDs), or which may each illuminate in multiple colors (e.g., multi-color or RGB LEDs) depending on the control signal from controller 160.

However, it should be appreciated that according to alternative embodiments, light sources 236 may include any other suitable traditional light bulbs or sources, such as halogen bulbs, fluorescent bulbs, incandescent bulbs, glow bars, a fiber light source, etc. Moreover, light sources 236 may be operably coupled (e.g., electrically coupled) to control board 234 or controller 160 (FIG. 2). Activation or illumination of light source 236 may be generally controlled by control board 234 or controller 160 (e.g., to indicate a user input, state of the dishwasher appliance, state of the wash cycle, or any other relevant information to a user).

Figure 5:
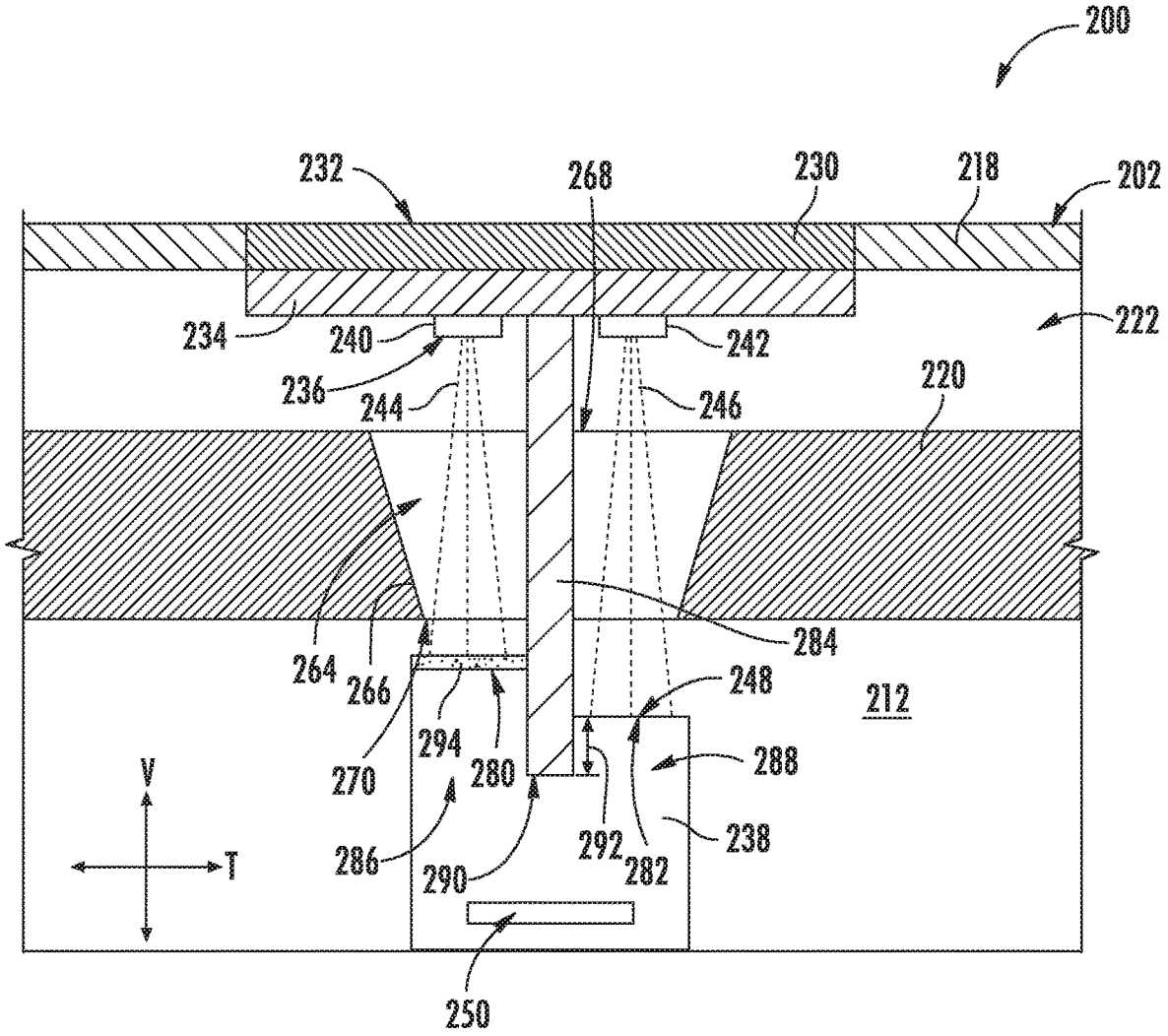
FIG. 5 provides a schematic view of a plurality of light sources illuminating the exemplary visual indicator of FIG. 3 according to an exemplary embodiment of the present subject matter.

Referring now specifically to FIG. 5, the particular configuration of the plurality of light sources 236 will be described according to an exemplary embodiment of the present subject matter. Specifically, as shown, the plurality of light sources 236 includes a first light source 240 and a second light source 242 positioned adjacent each other along the lateral direction L. In addition, first light source 240 and second light source 242 are illustrated as being mounted on the control board 234 (e.g. which may house controller 160). In addition, control board 234 is illustrated as being positioned below capacitive interface panel 230 within top panel 218. In general, first light source 240 may be selectively operated to emit a first portion of light energy 244 and second light source 242 may be selectively operated to emit a second portion of light energy 246. In some embodiments, light sources 240, 242 are directed substantially downward along the vertical direction V. Thus, when activated to illuminate indicator lens 238, light sources 240, 242 may project light emissions 244, 246 along the vertical direction V and generally toward the bottom end 204 (FIG. 2), opposite top panel 218.

Generally, indicator lens 238 may be any suitable transparent or semitransparent feature for diffusing, directing, or otherwise transmitting light from a light source, such as first light source 240 and second light source 242. For example, indicator lens 238 may be formed from a suitable transparent or translucent material configured to direct light energy 244, 246 therethrough. For example, indicator lens 238 may be constructed from glass, polycarbonate, polypropylene, polyacrylic, or any other suitable material.

When assembled, indicator lens 238 is spaced apart from light sources 236 along the vertical direction V. In particular, at least a portion of indicator lens 238 is positioned below light sources 236. Indicator lens 238 itself may extend from a split receiving surface 248 to a projection surface 250 that is nonparallel (e.g., perpendicular or set in another suitable angle between 0° and 180°) relative to split receiving surface 248. Split receiving surface 248 may face first light source 240 and second light source 242 to receive a light emissions therefrom. A projection path 252 for first portion of light energy 244 and second portion of light energy 246 may be defined through indicator lens 238 from split receiving surface 248 to projection surface 250. Thus, at least a portion of the light emissions received at split receiving surface 248 may be directed to projection surface 250 and then, for example, to a user facing the door.

According to the illustrated embodiment, due to the nonparallel receiving surface 248 and projection surface 250, projection path 252 may define a curve angle 254 (FIG. 3) through which indicator lens 238 must turn or reflect light energy 244, 246. According to the illustrated embodiment, curve angle 254 is approximately 90 degrees. However, it should be appreciated that according to alternative embodiments, curve angle 254 may be any other suitable angle, such as between about 0° and 180°, between about 60° and 120°, between about 80° and 100°, etc.

An indicator aperture 256 is defined through outer door panel 216. As shown, indicator aperture 256 may extend along the transverse direction T to permit light energy 244, 246 therethrough. For instance, indicator aperture 256 may be defined as a void extending fully through outer door panel 216 (e.g., completely through outer door panel 216 along the transverse direction T). In some such embodiments, at least a portion of indicator lens 238 (e.g., projection surface 250) is received through indicator aperture 256. In alternative embodiments, however, indicator aperture 256 is defined as a nonpermeable (e.g., to water) segment of outer door panel 216 through which light energy 244, 246 may pass. As an example, indicator aperture 256 may be a transparent or translucent portion of outer door panel 216 that generally permits at least a portion of visible light therethrough (e.g., from interior chamber 212 to the ambient environment surrounding the door).

When light source 236 is activated or illuminated, light energy 244, 246 from light sources 240, 242 may thus be directed along projection path 252 from split receiving surface 248 and through indicator aperture 256. Advantageously, the relative position of light sources 240, 242, indicator lens 238, and indicator aperture 256 may permit a significant amount light to be directed through interior chamber 212 along the projection path 252 and reduce the overall transverse depth that may be required for interior chamber 212. Moreover, the described embodiments may permit light sources 236 to be mounted on control board 234, further reducing complexity and space requirements within the door. In some embodiments, one or both of split receiving surface 248 and projection surface 250 define a corresponding noncircular surface area. Advantageously, the noncircular surface area defined by projection surface 250 may be more easily viewed (and thereby understood) than typical visual indicator lights (e.g., having a relatively small or circular shape).

As best shown in FIG. 3, console bracket 220 is positioned within interior chamber 212 such that light sources 240, 242 are supported on or above console bracket 220. As an example, sources 240, 242 may be attached to control board 234 above console bracket 220. Optionally, control board 234 and light source 236 may be attached to console bracket 220. In certain embodiments, sources 240, 242 are positioned above split receiving surface 248 (e.g., along the vertical direction V) and at least a portion of console bracket 220.

In additional or alternative embodiments, console bracket 220 defines a light channel 264 extending therethrough. In particular, light channel 264 may extend along the vertical direction V (e.g., generally along the vertical direction V such that one opening of the light channel 264 is positioned below the other opening of the light channel 264) between light sources 236 and split receiving surface 248. Specifically, according to the illustrated embodiment, light channel 264 may be defined by an inner wall 266 which is substantially cylindrical or tapered for directing light towards split receiving surface 248. According to an exemplary embodiment, inner wall 266 may be light-colored and polished for improved light redirection towards split receiving surface 248.

As shown in FIG. 3, light channel 264 is illustrated as a nonlinear void extending substantially along the vertical direction V. In this regard, light channel 264 is tapered from a large top or first opening 268 to a relatively small bottom or second opening 270. Thus, the cross-sectional area of light channel 264 may generally decrease from first opening 268 to second opening 270 positioned below first opening 268. In other words, the small opening may be positioned below the large opening (e.g., along the vertical direction V). Advantageously, the taper may focus light energy 244, 246 from light sources 240, 242, increasing the visibility and intensity of the light visible at projection surface 250. In addition, greater freedom and flexibility may be realized for mounting light source 236 relative to split receiving surface 248.

Although FIG. 3 illustrates light channel 264 as being tapered such that it narrows from the top to the bottom of light channel 264, it should be appreciated that other suitable shapes are possible and within the scope of the present subject matter. For example, light channel 264 may be defined as a linear void having a constant channel width or cross sectional area (e.g., a cylindrical shape) such that first opening 268 and second opening 270 are identically sized. Alternatively, light channel 264 may be tapered from a smaller first opening 268 to a larger second opening 270. In addition, it is understood that light channel 264 (e.g., the walls defining light channel 264) may extend at a nonparallel angle relative to the vertical direction V (e.g., such that the light source 236 is transversely or laterally offset from the split receiving surface 248).

Referring now generally to FIGS. 5 through 8, an indicator lens 238 which may be used with door assembly 200 will be described according to various exemplary embodiments of the present subject matter. Although various configurations are shown in the figures, like reference numerals will be used to refer to the same or similar features. As explained below, indicator lens 238 may provide a simple and effective means for illuminating a status indicator (e.g., such as display components 168) using relatively cheap single color LEDs which may be assembled quickly and easily to control board 234.

Specifically, as illustrated in the figures, split receiving surface 248 includes a first surface 280 and a second surface 282 that are positioned adjacent each other for receiving different beams of light energy. Specifically, first surface 280 may face toward first light source 240 for receiving first portion of light energy 244. Similarly, second surface 282 may face toward second light source 242 for receiving second portion of light energy 246. In addition, an opaque partition 284 may be positioned between first light source 240 and second light source 242 for at least partially blocking first portion of light energy 244 from reaching second surface 282 and second portion of light energy 246 from reaching first surface 280.

In this regard, for example, indicator lens 238 may define a first leg 286 extends from the first surface 280 of split receiving surface 248 toward projection surface 250. Similarly, indicator lens 238 may define a second leg 288 that extends from second surface 282 toward projection surface 250. A slot 290 is defined between a first leg 286 and second leg 288. According to an exemplary embodiment, opaque partition 284 is positioned at least in part within slot 290 between first leg 286 and second leg 288. Although exemplary embodiments described herein have two legs 286, 288, and a single opaque partition 284, it should be appreciated that according to alternative embodiments, a plurality of partitions may be used to separate three or more light sources 236 for illuminating three or more surfaces of split receiving surface 248.

According to the embodiment illustrated in FIG. 5, opaque partition 284 is defined as part of console bracket 220. In this regard, opaque partition 284 extends up from light channel 264, contacts control board 234, and extends along a plane defined by the vertical direction V and a transverse direction T. In addition, opaque partition 284 extends down toward indicator lens 238 to separate first portion of light energy 244 and second portion of light energy 246. However, according to alternative embodiments, opaque partition 284 may be formed along with indicator lens 238. In this regard, for example, opaque partition 284 may be second shot molded within slot 290 of indicator lens 238. Specifically, a first portion of indicator lens 238 may be molded with a clear material, e.g., to form first leg 286 and second leg 288. Thereafter, a second shot molding procedure may be used to mold opaque partition 284 out of the material that prevents light transfer therethrough.

Figure 7:
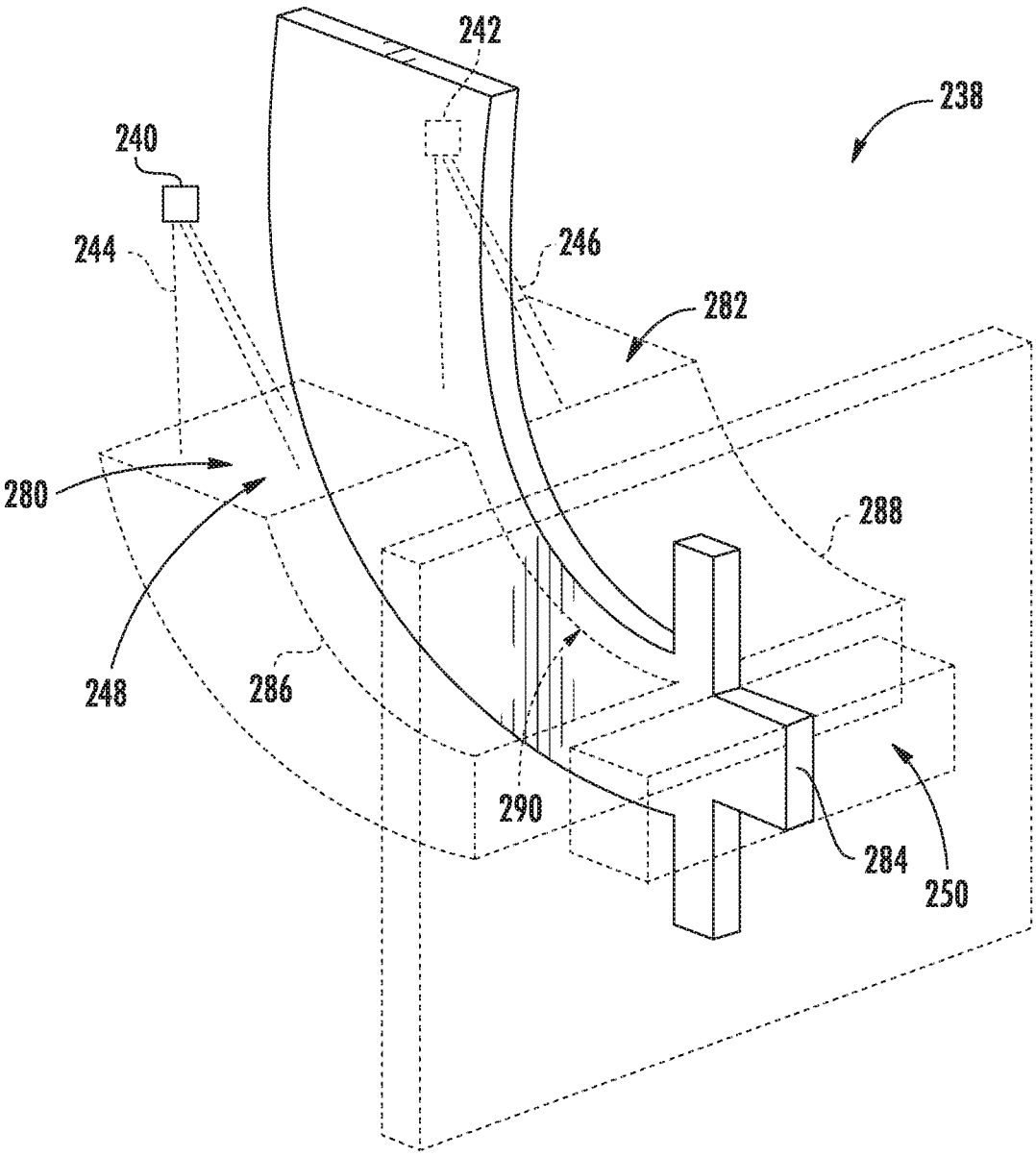
FIG. 7 provides a perspective view of the exemplary visual indicator of FIG. 3 according to another exemplary embodiment of the present subject matter.
Figure 8:
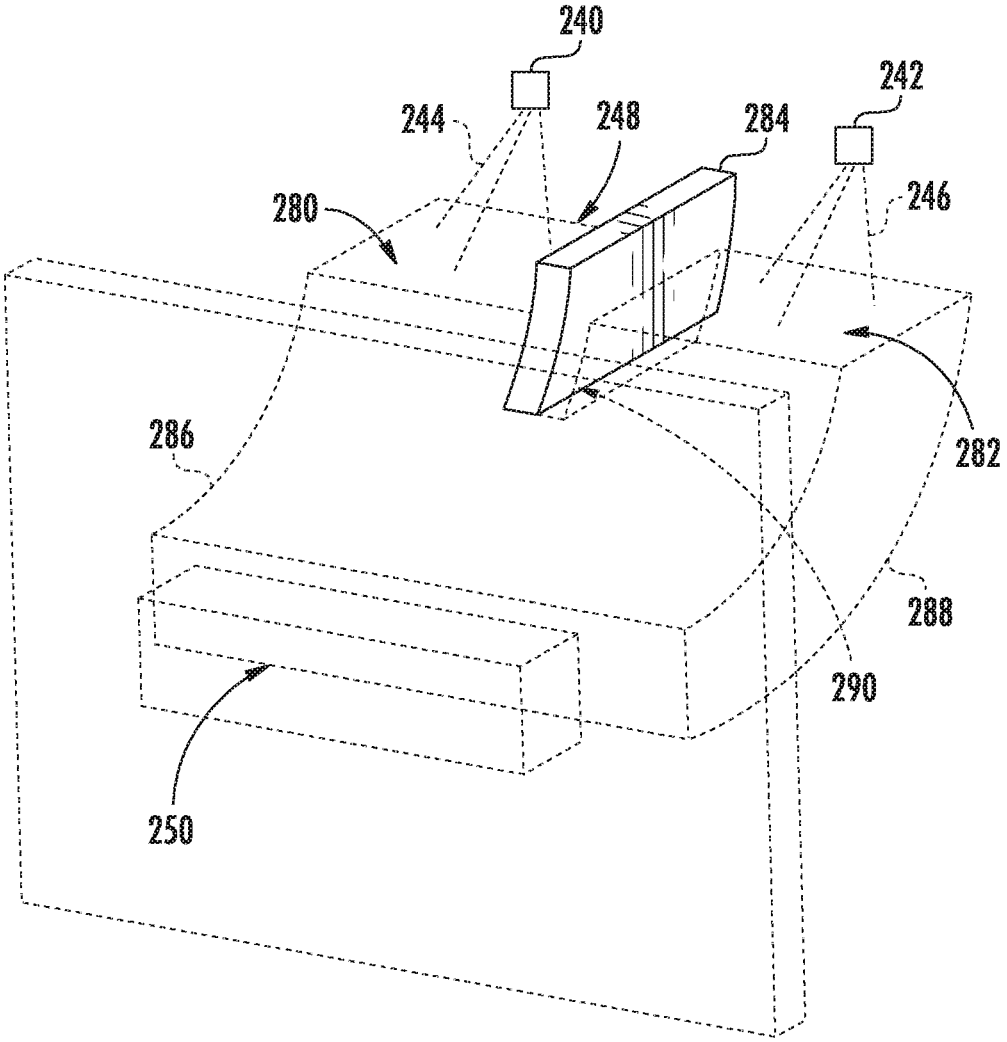
FIG. 8 provides a perspective view of the exemplary visual indicator of FIG. 3 according to yet another exemplary embodiment of the present subject matter.

As shown, opaque partition 284 extends into slot 290 to ensure first surface 280 and second surface 282 are illuminated only by the first portion of light energy 244 and second portion of light energy 246, respectively. Thus, opaque partition 284 may extend into indicator lens 238 any suitable depth for preventing bleeding of light energy 244, 246 between first leg 286 and second leg 288. For example, as illustrated in FIGS. 5 and 8, opaque partition 284 extends into indicator lens 238 by a depth 292 of less than 0.2 inches. It should be appreciated depth 292 may vary and be greater than 0.2 inches, greater than 0.5 inches, about 0.15 inches, or less according to alternative embodiments. For example, as illustrated in FIG. 7, opaque partition 284 extends through indicator lens 238 all the way to projection surface 250, e.g., to essentially form the dual-indication or two-sided status indicator bar.

Referring again to FIG. 5, indicator lens 238 may include features or materials that adjust the color or tint of the light passing therethrough. For example, indicator lens 238 may include a tinted film 294, material, or screen positioned on first surface 280 for coloring first portion of light energy 244 that passes through first leg 286 of indicator lens 238. By contrast, second surface 282 may remain clear for permitting clear or white LED light to pass therethrough (or could receive a different color tinted film 294). Notably, when door assembly 200 is set up in this manner, control board 234 (e.g., or controller 160) may illuminate first light source 240 to provide projection surface 250 with a colored light (e.g., red, blue, etc.) and may illuminate second light source 242 to illuminate projection surface 250 with another light (e.g., white or a different color using different tinted film 294).

Figure 6:
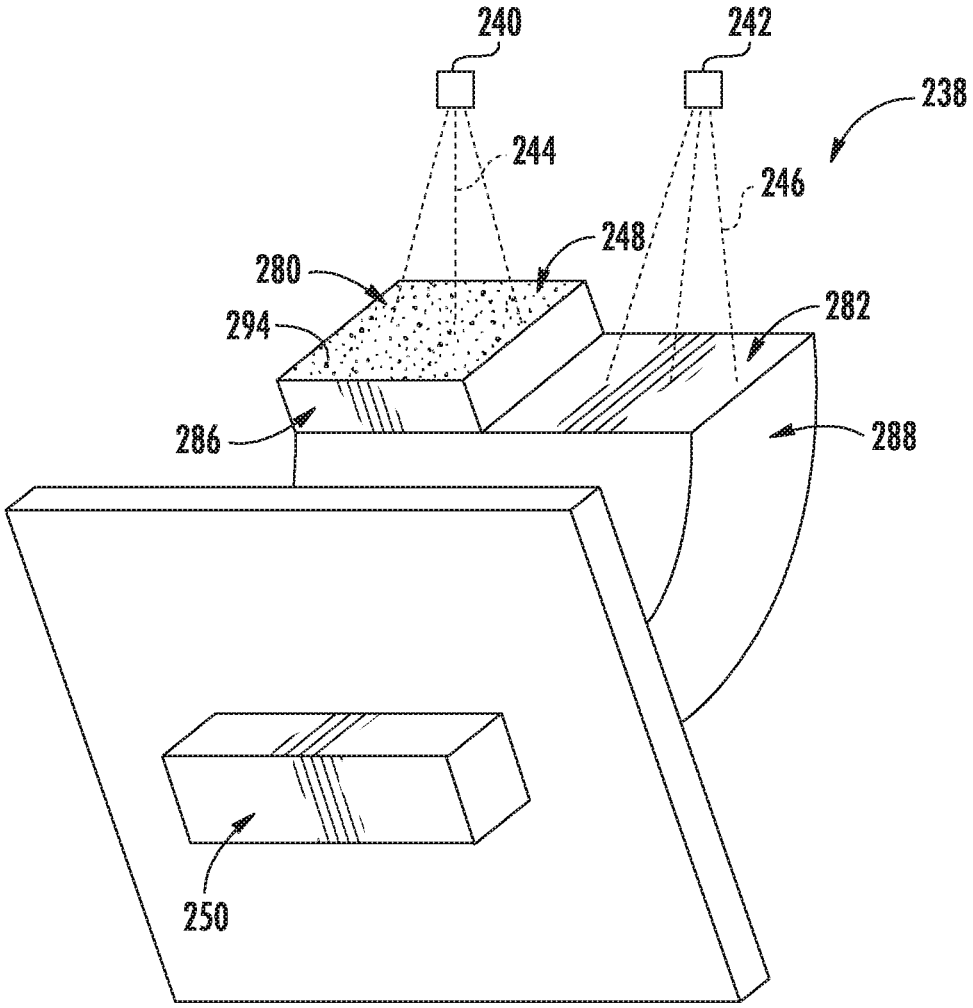
FIG. 6 provides a perspective view of the exemplary visual indicator of FIG. 3 according to an exemplary embodiment of the present subject matter.

As shown in FIGS. 5 and 6, according to one exemplary embodiment, first surface 280 in the second surface 282 may be positioned at different vertical locations. Specifically, as illustrated, first surface 280, which includes tinted film 294, is positioned above second surface 282 along the vertical direction V. In this manner, when the second portion of light energy 246 is directed through second surface 282, the light is going downward and will not reflect back upward and into the pigment or tinted film 294. By contrast, when first portion of light energy 244 is directed through first surface 280 and tinted film 294, if the colored light bleeds into second leg 288 there be no effect on the light output from indicator lens 238.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A door assembly for an appliance, the door assembly comprising:

an outer door panel defining an indicator aperture;

an inner door panel spaced apart from the outer door panel to define an interior chamber;

a first light source selectively emitting a first portion of light energy;

a second light source selectively emitting a second portion of light energy;

an indicator lens extending from a projection surface proximate the indicator aperture and a split receiving surface, the split receiving surface having a first surface facing the first light source and a second surface facing the second light source;

an opaque partition positioned between the first light source and the second light source for at least partially blocking the first portion of light energy from reaching the second surface and the second portion of light energy from reaching the first surface; and a light channel tapered between a first opening proximate the first light source and the second light source and a second opening proximate the split receiving surface, wherein one of the first opening and the second opening is smaller than the other of the first opening and the second opening.

2. The door assembly of claim 1, wherein at least one of the first surface or the second surface is tinted to adjust a color of the first portion of light energy or the second portion of light energy, respectively.

3. The door assembly of claim 1, wherein the opaque partition extends past the first surface and the second surface by less than 0.2 inches.

4. The door assembly of claim 1, wherein the opaque partition extends past the first surface and the second surface to a location proximate the projection surface.

5. The door assembly of claim 1, wherein the first surface is located at a different vertical location relative to the second surface.

6. The door assembly of claim 1, wherein the indicator lens further comprises:

a first leg extending from the first surface toward the projection surface;

a second leg extending from the second surface toward the projection surface; and a slot defined between the first leg and the second leg, wherein the opaque partition is molded into the slot between the first leg and the second leg.

7. The door assembly of claim 1, wherein the projection surface is nonparallel to the split receiving surface, the indicator lens defining a projection path directing at least a portion of the first portion of light energy and the second portion of light energy through the indicator aperture and from the projection surface.

8. The door assembly of claim 7, wherein the projection path defines an angle of curvature between about 60 and 120 degrees.

9. The door assembly of claim 1, wherein the first light source and the second light source face downward and direct the first portion of light energy and the second portion of light energy downward along the vertical direction.

10. The door assembly of claim 1, wherein the first light source and the second light source are single color light emitting diodes (LEDs).

11. The door assembly of claim 1, further comprising:

a third light source selectively emitting a third portion of light energy, wherein the split receiving surface has a third surface facing the third light source; and a secondary opaque partition positioned between the second light source and the third light source for at least partially blocking the second portion of light energy from reaching the third surface and the third portion of light energy from reaching the second surface.

12. The door assembly of claim 1, further comprising:

a console bracket extending between the inner door panel and the outer door panel along the transverse direction and between the first light source and the split receiving surface along the vertical direction.

13. The door assembly of claim 12, wherein the console bracket defines the light channel extending along the vertical direction between the first opening proximate the first light source and the second light source and the second opening proximate the split receiving surface.

14. The door assembly of claim 13, wherein the light channel is tapered such that the first opening is larger than the second opening.

15. The door assembly of claim 13, wherein the light channel is defined by a light colored, polished inner wall.

16. The door assembly of claim 12, wherein the opaque partition extends down from the console bracket and into a slot defined by the indicator lens.

17. The door assembly of claim 1, further comprising:

a top panel that extends between the inner door panel and the outer door panel at a top end of the door assembly; and a user interface panel mounted within the top panel, wherein the first light source and the second light source are mounted on a bottom side of the user interface panel.

18. The door assembly of claim 17, wherein the user interface panel is a capacitive interface panel comprising a control board, the first light source and the second light source being mounted to the control board.

19. The door assembly of claim 1, wherein the indicator lens is a light pipe formed from a glass, polycarbonate, polypropylene, or polyacrylic material.

20. A dishwasher appliance defining a vertical direction, a lateral direction, and a transverse direction, the dishwasher appliance comprising:

a wash tub positioned within the cabinet and defining a wash chamber;

a door assembly pivotally mounted to the cabinet to provide selective access to the wash chamber, the door assembly comprising:

an outer door panel defining an indicator aperture;

an inner door panel spaced apart from the outer door panel to define an interior chamber;

a first light source selectively emitting a first portion of light energy;

a second light source selectively emitting a second portion of light energy;

an indicator lens extending from a projection surface proximate the indicator aperture and a split receiving surface, the split receiving surface having a first surface facing the first light source and a second surface facing the second light source;

an opaque partition positioned between the first light source and the second light source for at least partially blocking the first portion of light energy from reaching the second surface and the second portion of light energy from reaching the first surface; and a light channel tapered between a first opening proximate the first light source and the second light source and a second opening proximate the split receiving surface, wherein one of the first opening and the second opening is smaller than the other of the first opening and the second opening.

* * * * *